United States Patent [19]

Elbe

[11] 4,008,537

[45] Feb. 22, 1977

[54] MODIFICATION OF RIFLE ADAPTER ASSEMBLY TO PREVENT DOUBLING

[75] Inventor: Ronald E. Elbe, Davenport, Iowa

[73] Assignee: The United States of America as represented by the Secretary of the Army, Washington, D.C.

[22] Filed: Oct. 3, 1975

[21] Appl. No.: 619,154

[52] U.S. Cl. ..... 42/16; 42/69 B; 42/77; 89/29

[51] Int. Cl.[2] ..... F41C 11/00; F41C 21/10

[58] Field of Search ..... 42/16, 49 A, 69 B, 77; 89/29

[56] References Cited

UNITED STATES PATENTS

| | | | |
|---|---|---|---|
| 2,824,400 | 2/1958 | Crittendon et al. | 42/16 |
| 3,771,415 | 11/1973 | Into et al. | 42/49 A |
| 3,776,095 | 12/1973 | Atchisson | 42/77 |

*Primary Examiner*—Charles T. Jordan
*Attorney, Agent, or Firm*—Nathan Edelberg; Harold H. Card, Jr.; Robert O. Richardson

[57] ABSTRACT

A bolt assembly on a rim fire adapter to permit a rifle to use smaller ammunition wherein an improvement is made to require cocking of the rifle hammer before the bolt can chamber another round and thus avoid the safety hazard of double firing.

A bolt extension block having a pivotal extension and extended hammer cocking surface is added to the rear of the bolt to achieve hammer cocking with less bolt recoil travel to insure that doubling or double firing will not occur.

9 Claims, 9 Drawing Figures

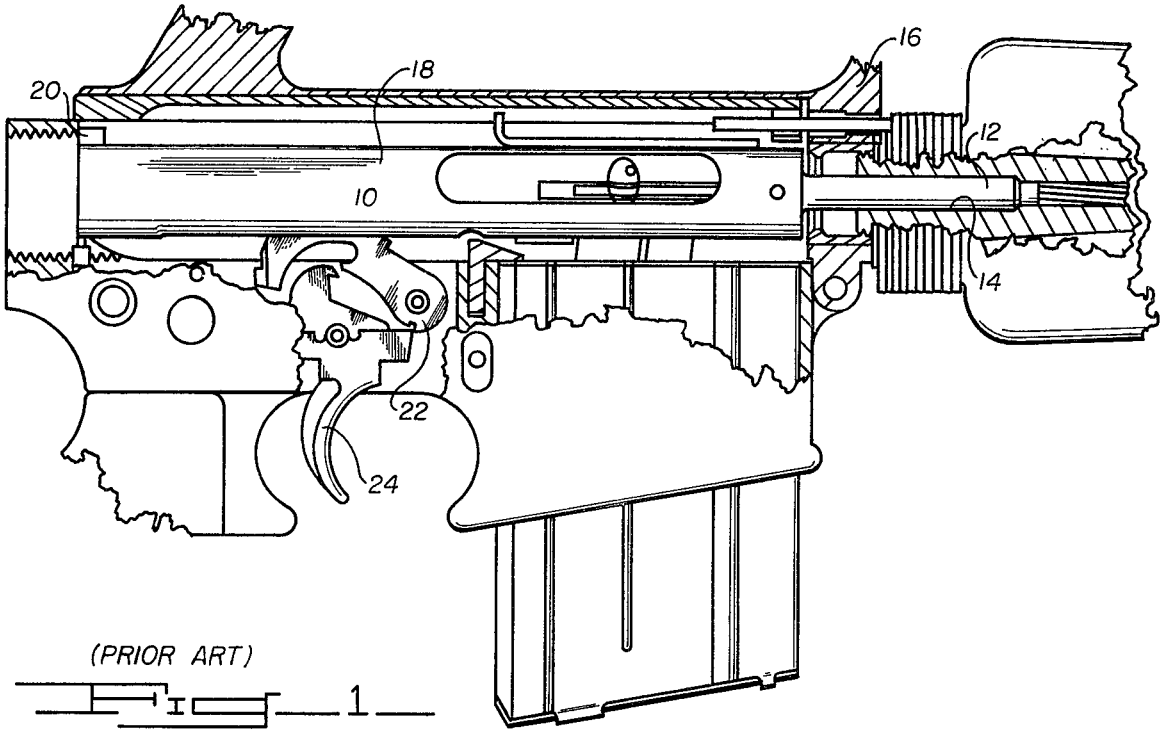
(PRIOR ART)
1
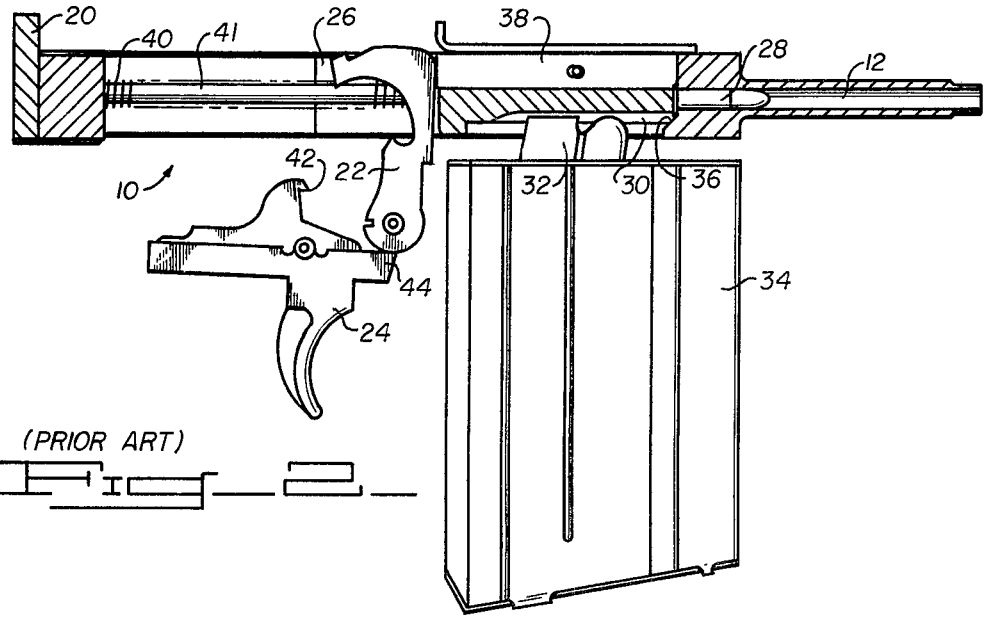
(PRIOR ART)
2

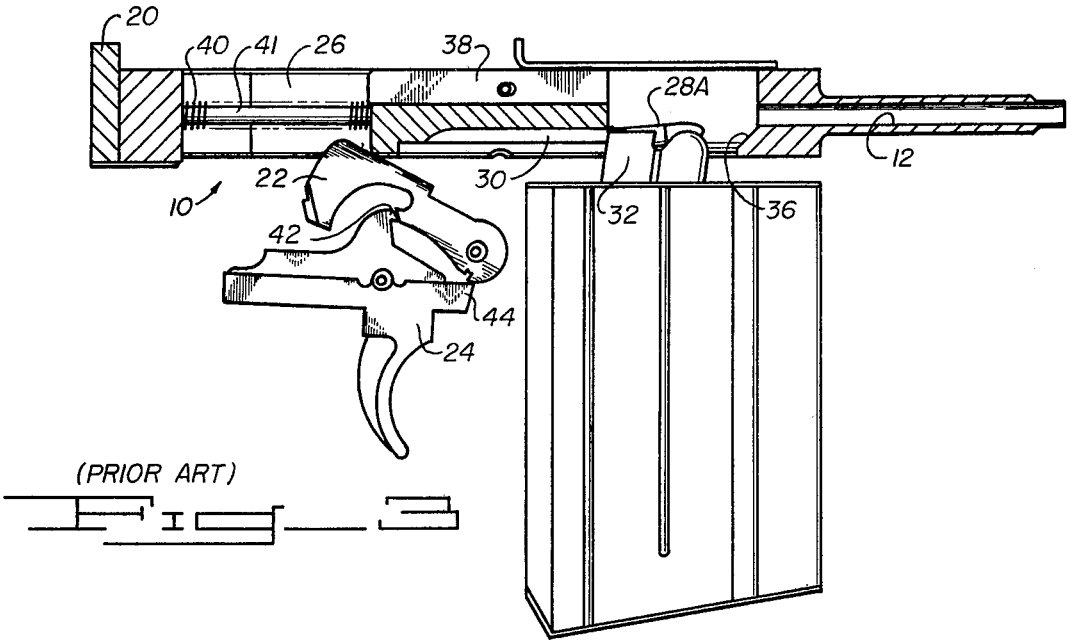
20
40
41
26
38
28A
12
22
30
10
32
36
42
44
24
(PRIOR ART)
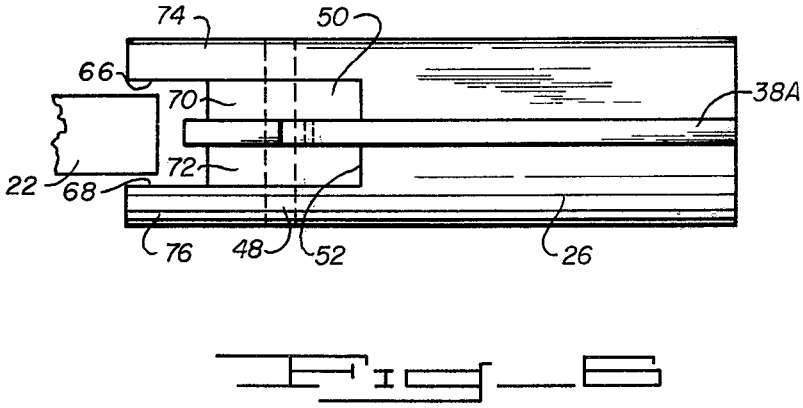
74
50
66
70
38A
72
22
68
76
48
52
26

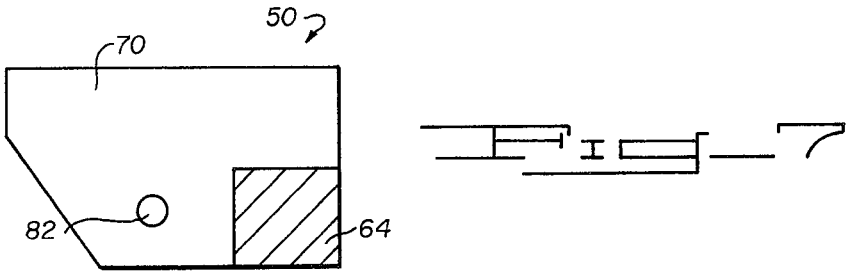
50
70
82
64
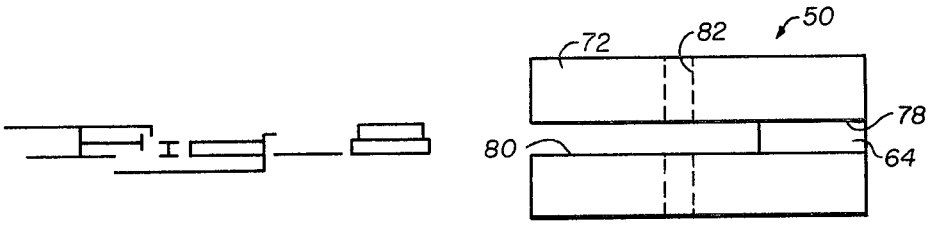
72
82
50
78
80
64
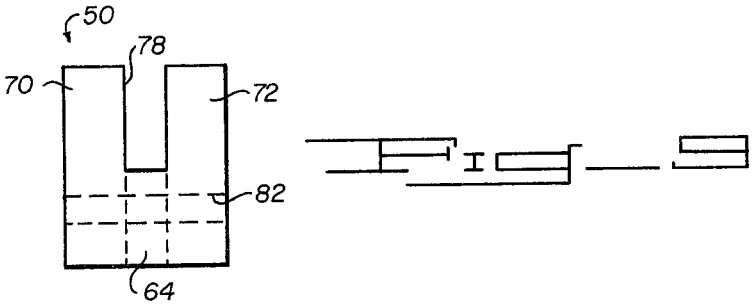
50
78
70
72
82
64

MODIFICATION OF RIFLE ADAPTER ASSEMBLY TO PREVENT DOUBLING

GOVERNMENT INTEREST

The invention described herein may be manufactured and/or used by or for the Government for governmental purposes without the payment of any royalty thereon.

BACKGROUND OF THE INVENTION

For training purposes it is desirable that trainees use the same weapon they would use in actual combat. However, it is also desirable that they use smaller caliber ammunition if possible. In the case of an infantry rifle, for example, if .22 caliber cartridges could be used instead of standard 5.56mm ammunition, the cost of the smaller training ammunition would be only 10% of that for which the rifle was designed. To achieve this 90% saving, rim fire adapter assemblies have been developed which replace the standard bolt and magazine assemblies in the rifle. One such magazine and bolt adapter is disclosed in copending application Ser. No. 617,203, filed Sept. 26, 1975, and entitled Rifle Adapter Assembly in which Applicant is a Co-inventor. In that invention bolt travel on recoil was such that the bolt caused the hammer to cock before the bolt chambered the next cartridge from the magazine. This prevented a safety hazard known as doubling.

All known commercially available rimfire adapters share this common safety hazard of having a potential for doubling, that is, firing two cartridges upon the squeeze of the trigger. During recoil, the feed position of the bolt for chambering the next round is reached before the hammer is cocked. Consequently, a short recoil can cause the empty case to be extracted and ejected, and a live round to be fed into the chamber, whereupon the uncocked hammer will follow the bolt into battery, firing the live cartridge. Thus, two cartridges will have been fired with one pull of the trigger. Repetition of this malfunction can result in several cartridges being fired with one trigger pull.

SUMMARY OF THE PRESENT INVENTION

In accordance with the present invention, a modification is made to a commerically available rim fire adapter for a rifle to overcome the potential doubling safety hazard. One such adapter is disclosed in U.S. Pat. No. 3,776,095 entitled Weapon Conversion Bolt Assembly Device issuing Dec. 4, 1973 to Maxwell G. Atchisson. In overcoming the potential doubling safety hazard in this adapter a pivotal extension has been made to the aft end of the conversion bolt to cause the hammer of the rifle to be cocked before the next round from the magazine can be chambered as the bolt moves to battery position. This extended hammer cocking surface is added to the rear of the bolt to achieve hammer cocking with less bolt recoil travel. Thus a .22 caliber cartridge with a minimum of firepower and bolt recoil power will cock the hammer before the bolt has fully recoiled and then advances to feed the next cartridge from the magazine into the adapter chamber, ready for firing.

BRIEF DESCRIPTION OF DRAWINGS

FIG. 1 is a side elevational view, with rifle parts broken, showing the operation of a commercially available rim fire adapter, FIG. 2 is a sectional view of the adapter with the rifle hammer in the fired position, FIG. 3 is a sectional view of the adapter with the bolt recoiled to the feed position but without cocking the hammer, FIG. 6 is a plan view of the bolt assembly with the hammer cocking surface and pivotal extension added, FIG. 7 is a side view of the extender, FIG. 8 is a plan view, and FIG. 9 is an end view of the extender.

DETAILED DESCRIPTION OF ILLUSTRATIVE EMBODIMENT

Figure 4:
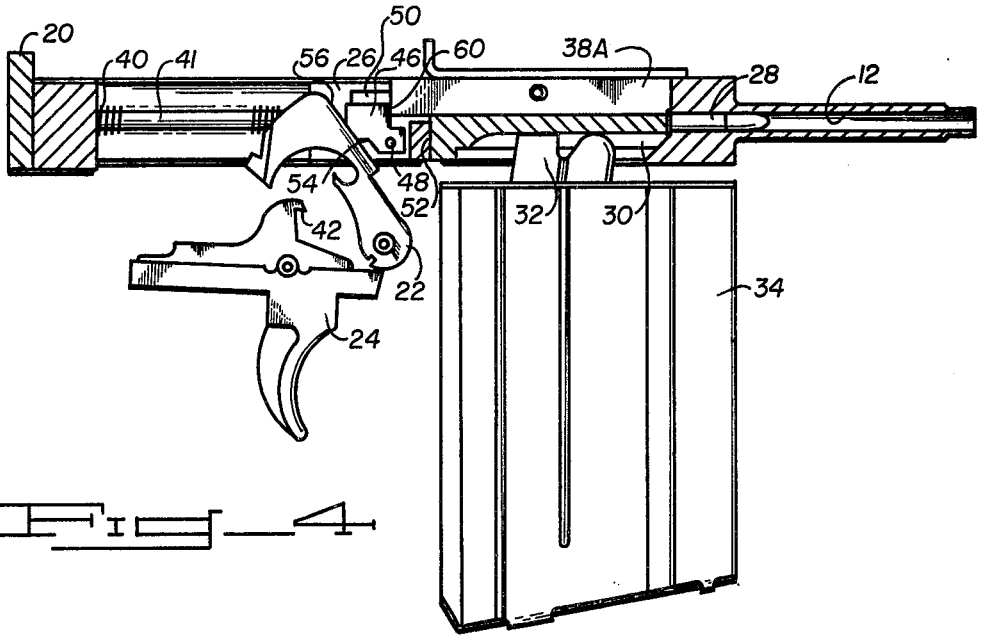
FIG. 4 is a sectional view of the adapter as in FIG. 2 but with the hammer cocking surface and pivotal extension added to the bolt.

Before describing the present invention, an illustration of the prior art device and the problem generated by it should first be had with reference to FIGS. 1, 2, and 3. In FIG. 1 there is shown a conversion bolt adapter assembly 10 of the type similar to that shown and described in the Atchisson patent earlier mentioned. Briefly, the adapter assembly 10 replaces the conventional rifle bolt and includes a conversion chamber 12 adapted to fit into the rifle chamber 14. The conversion chamber has a smaller bore to receive cartridges of the smaller size for which the rifle 16 is now adapted. Side members 18 space the conversion chamber 12 from a rear buffer unit 20 that impacts the bolt recoil.

Between side members 18 is a longitudinal slot or gap through which rotates the rifle hammer 22 as it moves between the cocked and firing positions. Trigger 24 is shown searing the hammer 22 in the cocked position.

In FIG. 2 there is shown the bolt 26 in its forward or battery position against cartridge 28 which is chambered in the conversion chamber 12. When bolt 26 moved forward, ridge 30 on the bolt moved cartridge 28 from between lips 32 at the top of magazine 34, up ramp 36, and into chamber 12.

In FIG. 2 trigger 24 has been depressed, releasing hammer 22 which has struck the rear end of firing pin 38. This pin, in turn, is shown in the process of rim firing cartridge 28. Obviously, pin 38 could be adapted for center firing if that kind of cartridge were used.

In FIG. 3 the bolt 26 has recoiled to the feed position, the bolt being adapted for gas blowback operation. Spring 40 on guide rod 41 continually urges bolt 26 forward to battery position as shown in FIG. 2. It is to be noted that in FIG. 3 bolt 26 has failed to rotate hammer 22 sufficiently to engage either the disconnect hook 42 on trigger 24 or its sear 44. (Disconnect hook 42 normally catches and holds hammer 22 in the cocked position when trigger 24 is still squeezed and sear 44 normally keeps hammer 22 cocked when the trigger 24 is released.) In this position it should also be noted that ridge 30 on the bolt is behind cartridge 28A in lips 32 of magazine 34 and upon counterrecoil or forward movement of bolt 26, under urging of spring 40, will chamber it. This forward momentum is increased by rotation of uncocked hammer 22 which, with hammer 22 engaging firing pin 38, could cause doubling, or the second cartridge to fire with only one trigger pull.

This lack of sufficient recoil in a gas blowback operated bolt may be due to lack of gas pressure because of gas leakage when smaller cartridges are used or it may be due to inadequate firepower in some of the smaller cartridges themselves. In any event, the condition exists and potential doubling is a safety hazard in this type of rim fire adapter which permits use of smaller and cheaper cartridges in a rifle designed for larger, more powerful, and more expensive cartridges.

Figure 5:
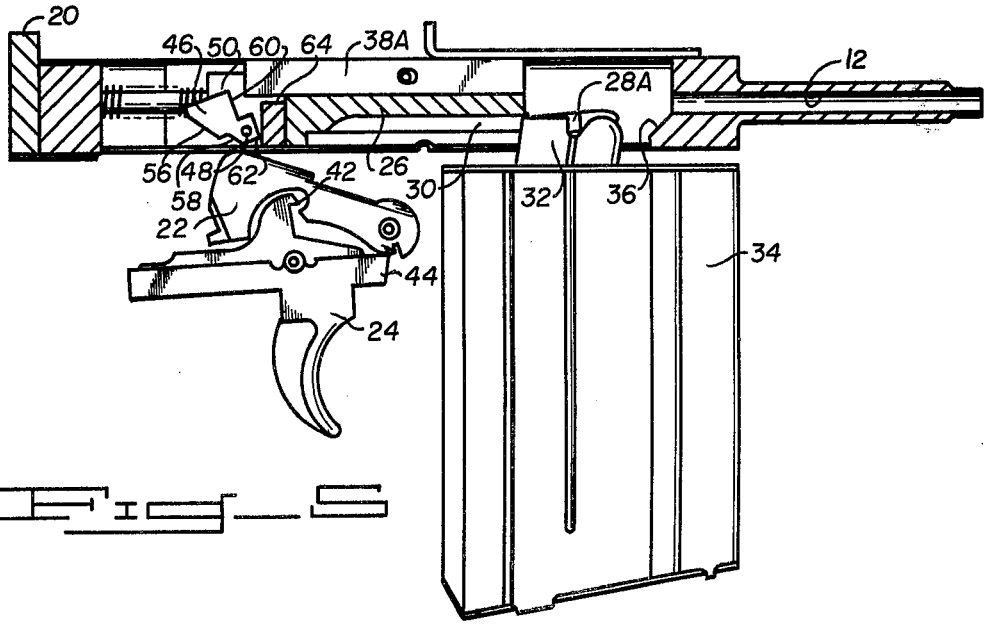
FIG. 5 is a sectional view of the adapter as in FIG. 3, with the bolt recoiled to the feed position and with the hammer cocked.

Having defined the problem presented by commercially available rim fire adapters, reference is now had to FIGS. 4 and 5 for the solution as set forth by the present invention. Like numbers identify like parts since the rifle and conversion bolt adapter assembly are the same except as hereinafter noted. FIG. 4 is similar to FIG. 2 in that the adapter assembly is in battery position with the cartridge 28 in chamber 12 just being fired by firing pin 38A striking the cartridge rim. However, between hammer 22 and firing pin 38A (which extends rearwardly further than firing pin 38 in FIG. 2) is a pivotal extension 46 pivotally mounted on pin 48 to a bolt extension block 50 which, in turn, is affixed, such as by welding, to the lateral end surface 52 of bolt 26. Bolt extension 50 has an extended hammer cocking surface 54 against which the hammer 22 bears both when firing and when cocking upon recoil of the bolt 26.

In the "just fired" position in FIG. 4, hammer 22 bears against the diagonally sloped hammer contact surface 56 on pivotal extension 46. This surface terminates in a clearance cut 58 to insure pressure from the hammer 22 about pivot pin 48 in a clockwise direction as seen in FIG. 4. The firing pin contact surface 60 is vertical and its plane passes through pivot pin 48 to insure axial pressure on firing pin 38A.

FIG. 5 is similar to FIG. 3 in that bolt 26 is shown recoiled to the feed position after firing. Ridge 30 on bolt 26 is behind cartridge 28A ready to drive it into conversion chamber 12 on counterrecoil. Pivotal extension 46 has counterrotated about pivot pin 48 due to its heavier mass rearwardly of the pivot. Corner 62 of extension 46 bears against crossmember 64 of extension block 50 which acts as a pivot stop to prevent further counterrotation of pivotal extension 46.

It should be noted that when bolt 26 is in the feed position, as shown, the hammer 22 is rotated rearwardly by the extended hammer cocking surface 54 on the bolt extension block 50. This rearward movement of hammer 22 is sufficient to cock it either with disconnect hook 42 or sear 44 of trigger 24. Thus, hammer 22 is always cocked before the next round 28A is chambered. Hence, no doubling is possible.

The appearance and location of the bolt extension block 50 is illustrated in FIGS. 6, 7, 8, and 9. As shown in the plan view of the bolt assembly in FIG. 6, block 50 fits against bolt end surface 52 and between side surfaces 66, 68 which serve as guides between which hammer 22 passes in striking pivotal extension 46. Pivot pin 48 passes through opposed side pieces 70, 72 of block 50, through extension 46 and, optionally, through opposed sides 74, 76 of bolt 26. In addition to block 50 being affixed to end surface 52 of bolt 26, it is also affixed to, such as by welding, side surfaces 66, 68 of bolt sides 74, 76.

Block 50 is shown in side, plan and end views in FIG. 7, 8, and 9. From these views it can be seen that the block, in one embodiment, originally may have been a rectangular cube upon which machine shop operations have been performed. An upper longitudinal slot 78 is made to permit longitudinal movement of the firing pin 38A and also rotational movement of pivotal extension 46. A vertical slot 80 communicating with slot 78 completes the clearance needed for the pivotal extension 46 which is thereafter mounted to the resultant side pieces 70, 72 by a pivot pin 48 passing through apertures 82. The resulting connection between the side pieces 70, 72 is the crossmember 64.

Instead of cutting slots, other ways of making a bolt extension block 50 might be casting or molding an integral piece or uniting side pieces and crossmember into an integral piece such as by welding, for example.

Having thus described an illustrative embodiment of the present invention, other modifications will become obvious to those skilled in the art and it is to be understood that these deviations are to be construed as part of the present invention as herein claimed.

What is claimed is:

1. A conversion unit for a rifle bolt for a rifle having a hammer, and a firing pin on the rifle bolt, said unit being used to prevent doubling by insuring that the rifle hammer is cocked upon recoil of the rifle bolt before chambering a subsequent round upon counterrecoil of the bolt, said conversion unit comprising:

a bolt extension block affixed to the aft end of said bolt, said block having an extended hammer cocking surface for engaging said hammer during recoil, and an extension movably mounted on said block for transmitting striking force from said hammer to the firing pin on said bolt.

2. A conversion unit as set forth in claim 1 wherein said rifle bolt has a ridge thereon for engaging a cartridge upon counterrecoil, and wherein said extended hammer cocking surface moves said hammer sufficiently rearwardly during recoil to cause said hammer to become cocked before counterrecoil of said bolt.

3. A conversion unit as in claim 1 wherein said extension is pivotally mounted on said block and wherein said extension has a hammer contact surface and a firing pin contact surface.

4. A conversion unit as in claim 1, wherein said bolt extension block has opposed face plates between which said firing pin on said bolt is longitudinally movable and between which said extension is pivotally mounted.

5. A conversion unit as in claim 4 wherein said opposed face plates are affixed to opposed sides on said bolt.

6. A conversion unit as in claim 1 wherein said block has a rear surface against which said hammer contacts after said hammer strikes said extension.

7. In combination with a rifle having a firing chamber, cartridge magazine, trigger, and hammer, a receiver having a bolt slidably mounted therein for longitudinal movement between a rearward feed position and a forward battery position, said bolt having means thereon for moving a cartridge from said magazine into said chamber during forward movement of said bolt, said bolt having a firing pin thereon longitudinally movable forwardly for firing said cartridge, said bolt having spaced sides at the rear thereof between which an extension is movably mounted, said extension having a firing pin contacting surface and a hammer contacting surface, said hammer having a cocked position to which said hammer moves upon rearward movement of said bolt, and a firing position to which said hammer moves upon release from said cocked position by depression of said trigger, said bolt cocking said hammer upon rearward movement thereof before chambering a cartridge upon forward movement thereof.

8. The combination as set forth in claim 7 wherein said extension is pivotally mounted on said bolt.

9. The combination as set forth in claim 7 wherein spacing on said bolt between the hammer cocking means thereon and the cartridge chambering means thereon is at least as long as the distance between said hammer in cocked position and the position of the cartridge to be chambered.

* * * * *